US010780552B2

(12) United States Patent
Wang et al.

(10) Patent No.: US 10,780,552 B2
(45) Date of Patent: Sep. 22, 2020

(54) WOODWORKING VICE

(71) Applicant: Fulian Zheng, Jinhua (CN)

(72) Inventors: Wenda Wang, Jinhua (CN); Zhaohan Jiang, Jinhua (CN)

(73) Assignees: Fulian Zheng, Yongkang (CN); YONGKANG TIANGONG TOOLS CO., LTD., Yongkang (CN); Zhaohan Jiang, Yongkang (CN)

( * ) Notice: Subject to any disclaimer, the term of this patent is extended or adjusted under 35 U.S.C. 154(b) by 183 days.

(21) Appl. No.: 16/147,757

(22) Filed: Sep. 30, 2018

(65) Prior Publication Data

US 2019/0099861 A1 Apr. 4, 2019

Related U.S. Application Data

(63) Continuation of application No. PCT/CN2018/097295, filed on Jul. 26, 2018.

(30) Foreign Application Priority Data

May 26, 2017 (CN) ..... 2017 2 0603181 U

(51) Int. Cl.

| | |
|---|---|
| ***B25B 1/24*** | (2006.01) |
| ***B25B 1/12*** | (2006.01) |
| ***B25B 1/02*** | (2006.01) |
| ***B25B 1/16*** | (2006.01) |
| ***B25H 1/06*** | (2006.01) |

(52) U.S. Cl.

CPC ..... *B25B 1/125* (2013.01); *B25B 1/02* (2013.01); *B25B 1/16* (2013.01); *B25B 1/24* (2013.01); *B25H 1/06* (2013.01)

(58) Field of Classification Search

CPC .... B25B 1/16; B25B 1/06; B25B 1/02; B25B 1/125; B25B 1/24

See application file for complete search history.

(56) References Cited

U.S. PATENT DOCUMENTS

| | | | | |
|---|---|---|---|---|
| 5,524,872 | A * | 6/1996 | Lewin | B25B 1/16 269/210 |
| 8,276,895 | B2 * | 10/2012 | Brown | B23K 37/0435 269/45 |
| 10,668,599 | B2 * | 6/2020 | Corcoran | B25B 1/24 |
| 2009/0121405 | A1 * | 5/2009 | Brown | B25B 1/16 269/216 |
| 2019/0099861 | A1 * | 4/2019 | Wang | B25B 1/16 |

* cited by examiner

*Primary Examiner* — Lee D Wilson

(74) *Attorney, Agent, or Firm* — Schwegman, Lundberg & Woessner, P.A.

(57) ABSTRACT

A woodworking vice including a frame, the frame has a clamp assembly and a connection rod matching with the assembly, and a front end of the rod is hinged to the frame. A rear end of the rod is provided with an extending frame extending upwardly, a front end of a locking member is hinged to an upper end of the extending frame, and a middle portion of a rocker is hinged to the upper end of the extending frame and is located below the locking member. The locking member is provided with a cooperation hole, and the locking member is equipped with a torsion spring making the locking member have a tendency of rotating clockwise. A rear portion of the frame is provided with a locking rod extending downwardly, the rod passes through the cooperation hole, and a rear end of the rocker is matched with the locking member.

5 Claims, 8 Drawing Sheets

WOODWORKING VICE

CROSS REFERENCE TO RELATED APPLICATIONS

This application is a continuation of PCT Application No.: PCT/CN2018/097295 filed Jul. 26, 2018, which claims priority to CN 201720603181.6 filed May 26, 2017 (priority was restored in the PCT application), both of which are incorporated herein by reference.

BACKGROUND OF THE INVENTION

Field of the Invention

This invention relates to a field of clamp technology and, more particularly, to a woodworking vice.

Description of the Related Art

When a woodworker is working, it is often necessary to clamp a workpiece on a workbench. For example, the workpiece is held by a woodworking vise. When an ordinary woodworking vice is used, after the workpiece is held tightly by the jaws, relevant components are often pulled manually to achieve locking. The drawback is that the manipulation is cumbersome and extremely laborious.

BRIEF SUMMARY OF THE INVENTION

The objective of this invention is to provide a woodworking vice, which is convenient and easy to operate.

The technical solution adopted by this invention is as follows. A woodworking vice includes a frame, the frame is provided with a clamp assembly and a connection rod matching with the clamp assembly, and a front end of the connection rod is hinged to the frame;

a rear end of the connection rod is provided with an extending frame extending upwardly, a front end of a locking member is hinged to an upper end of the extending frame, and a middle portion of a rocker is hinged to the upper end of the extending frame and is located below the locking member. A rear portion of the frame is provided with a locking rod extending downwardly, the locking member is provided with a cooperation hole, and the locking member is equipped with a torsion spring making the locking member have a tendency of rotating clockwise. The locking rod passes through the cooperation hole, and a rear end of the rocker is matched with the locking member;

the rear end of the connection rod is connected with a bracket extending downwardly, and the bracket cannot rotate clockwise relative to the connection rod. A middle portion of a pedal is hinged to a lower end of the bracket, a front end of the pedal is connected with a transmission rod, and an upper end of the transmission rod is connected with a front end of the rocker.

The transmission rod may be equipped with a compression spring making the transmission rod have a tendency of moving upwardly.

The rear end of the rocker may be provided with a supporting wheel, and the supporting wheel may be below and support the locking member.

The extending frame may be fixed with a retractable member extending upwardly, an upper end of the retractable member may be hinged to a swing arm, and the locking member may be hinged to the swing arm.

The retractable member may include a thread insert and a screw screwed into the thread insert.

After adopting the above-mentioned structure, this invention has the advantages compared with the prior art: the operation is convenient and relatively easy. When the woodworking vice of this invention is used, by stepping down the rear portion of the pedal by the heel of a foot, the connection rod can be rotated clockwise to lock the clamp assembly, and the connection rod cannot be reset by itself. When the connection rod is required to be reset, it is only needed to step on the front portion of the pedal by the sole of the foot. The cooperation hole and the locking rod will lose the lock between each other, and the connection rod will reset itself, which is extremely convenient and easy.

BRIEF DESCRIPTION OF THE DRAWINGS

This invention is further described below with reference to the accompanying drawings and embodiments.

DETAILED DESCRIPTION OF THE INVENTION

Figure 1:
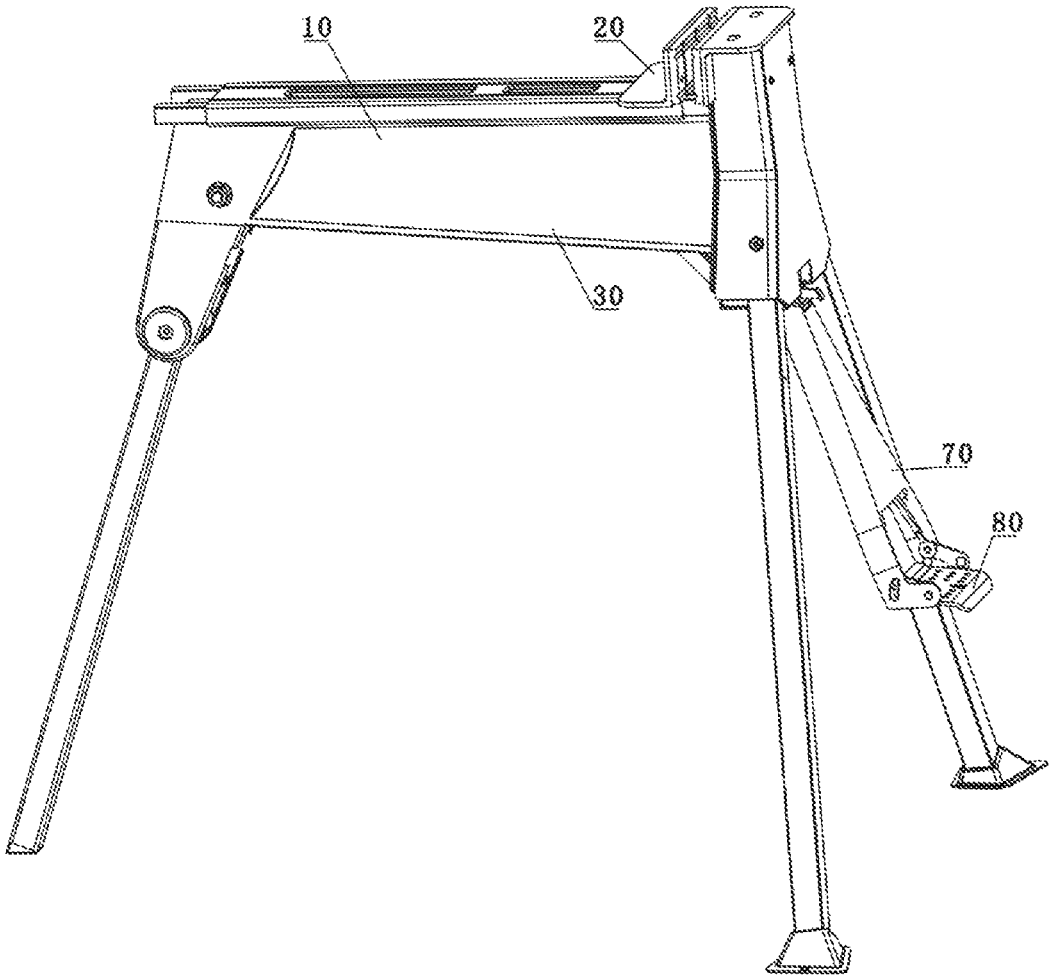
FIG. 1 is a perspective view of a woodworking vice according to an embodiment of this invention (the following drawings are all enlarged relative to FIG. 1)
Figure 2:
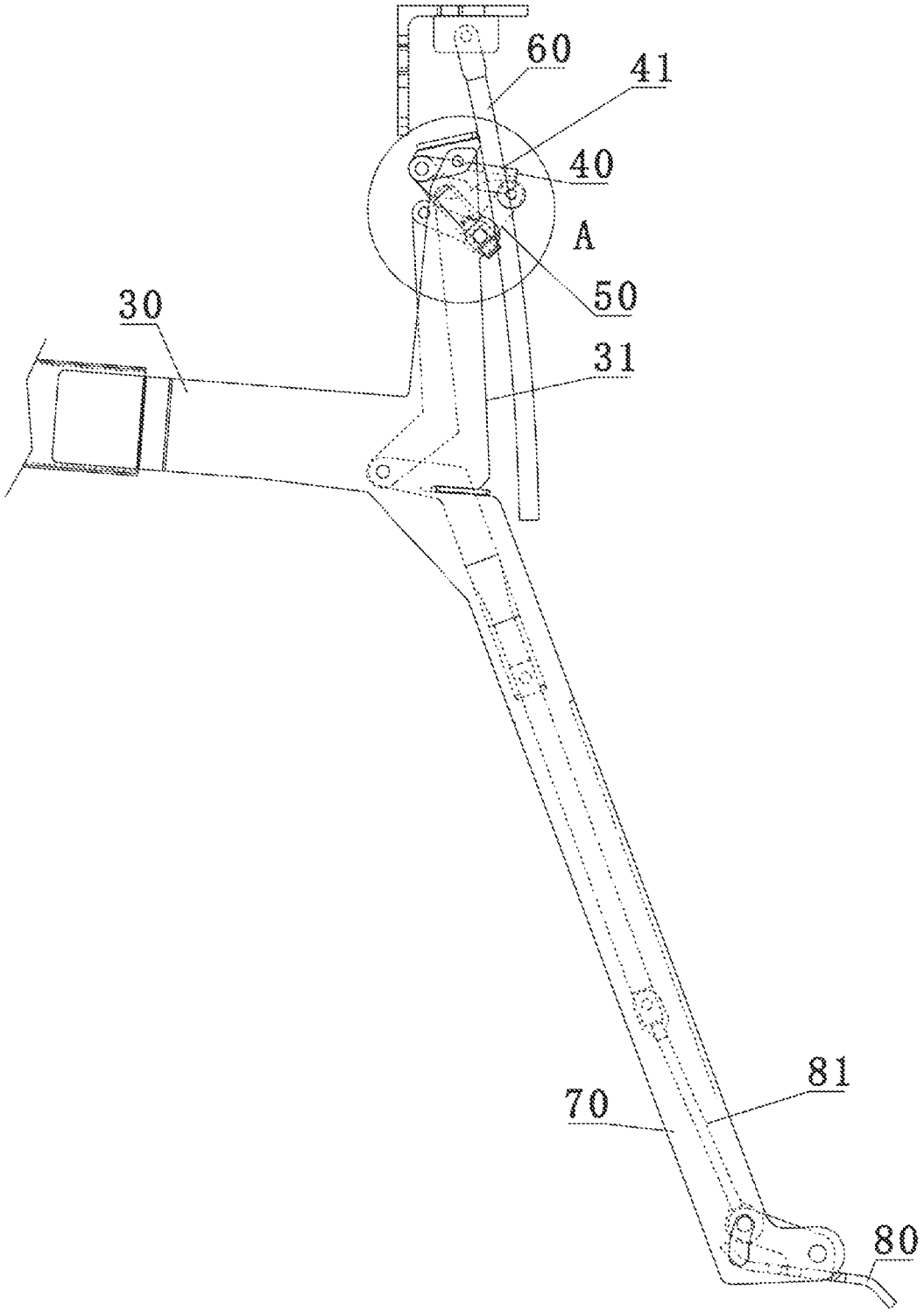
FIG. 2 is a partial view (partial cross-sectional view) of the woodworking vice according to the embodiment of this invention.
Figure 3:
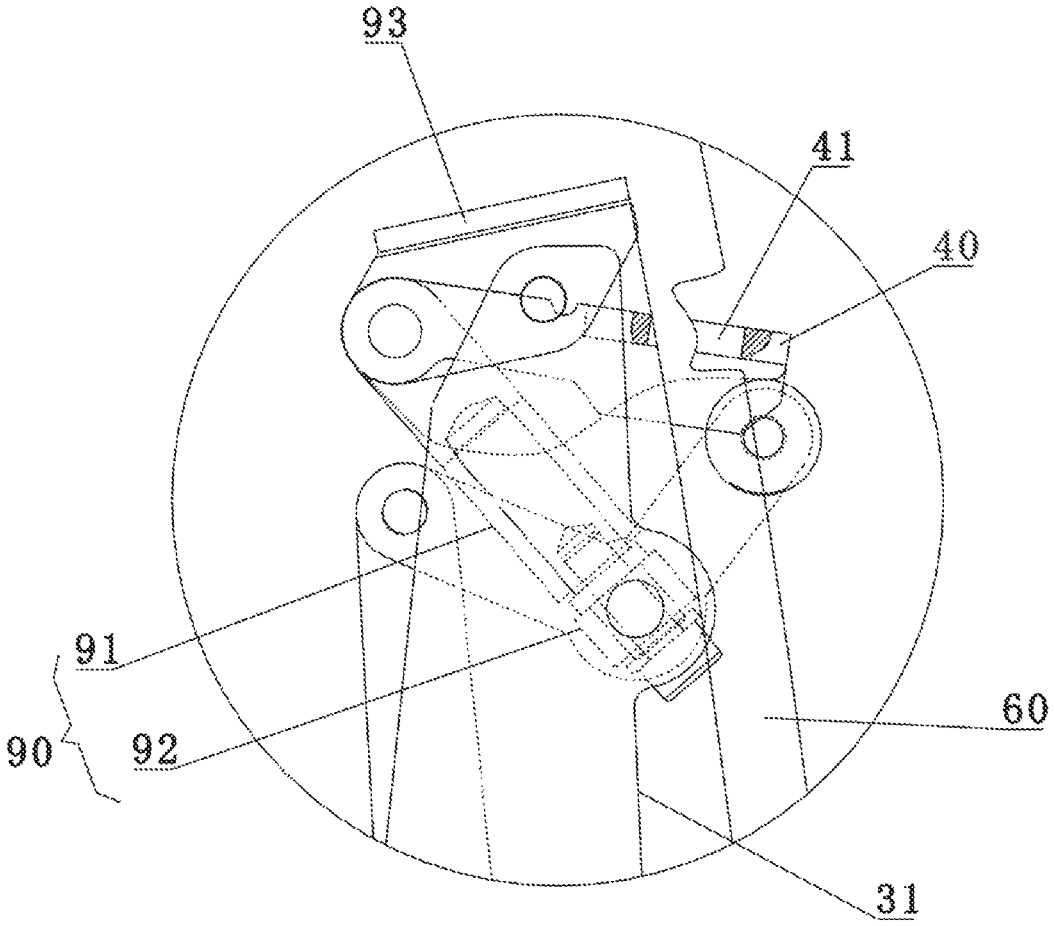
FIG. 3 is an enlarged view of a portion A of FIG. 2.
Figure 4:
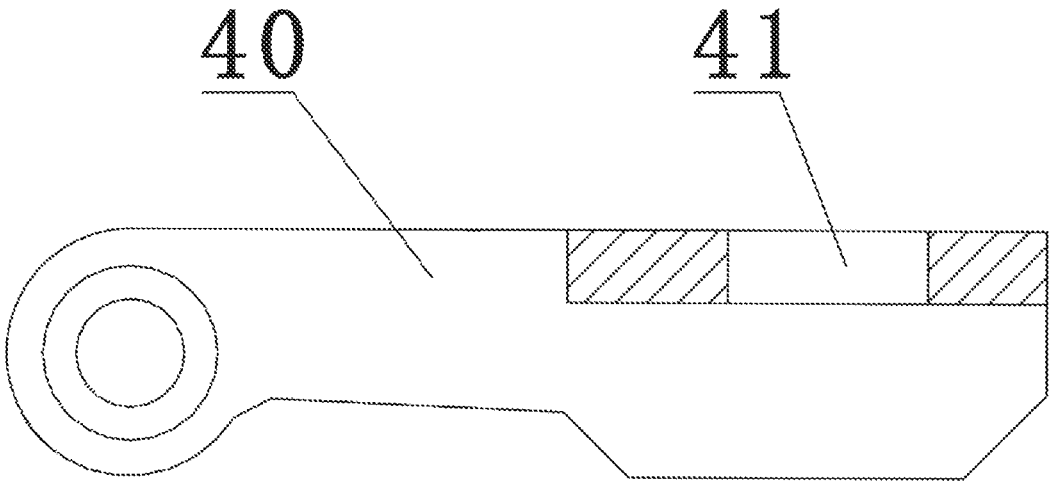
FIG. 4 is a front view (partial cross-sectional view) of a locking member according to this invention.
Figure 5:
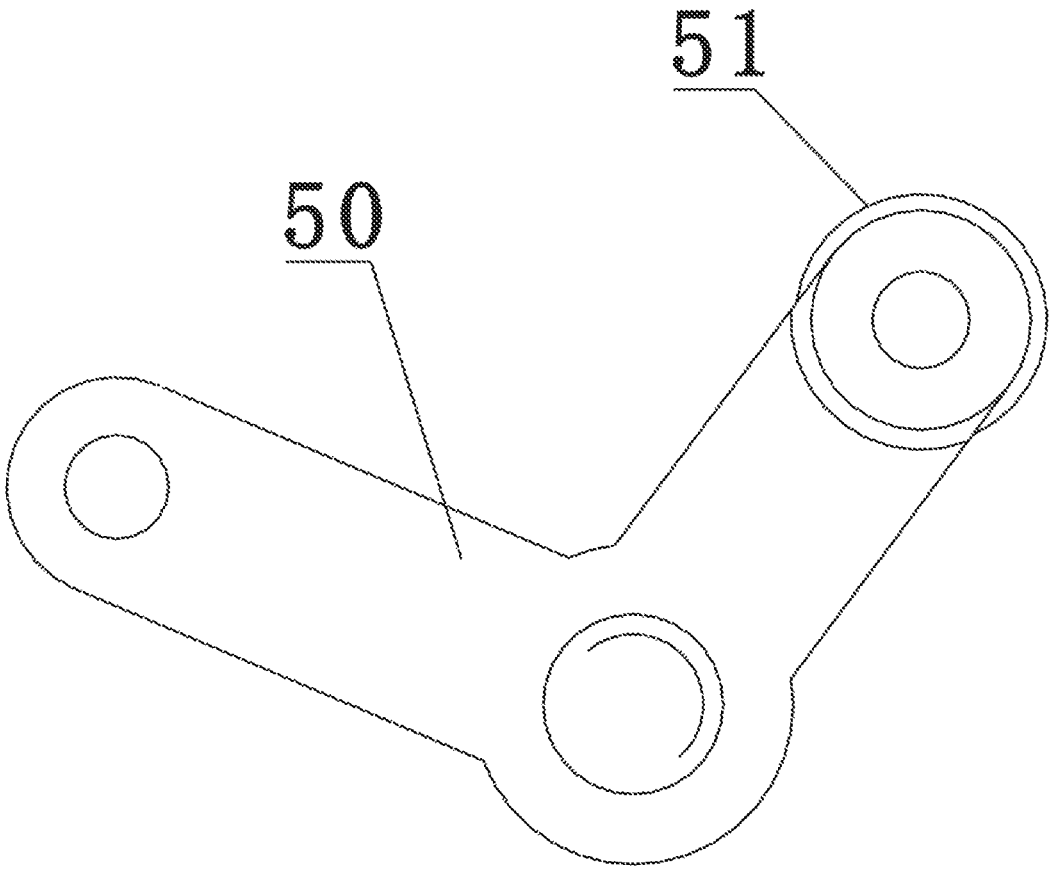
FIG. 5 is a front view of a rocker according to this invention.
Figure 6:
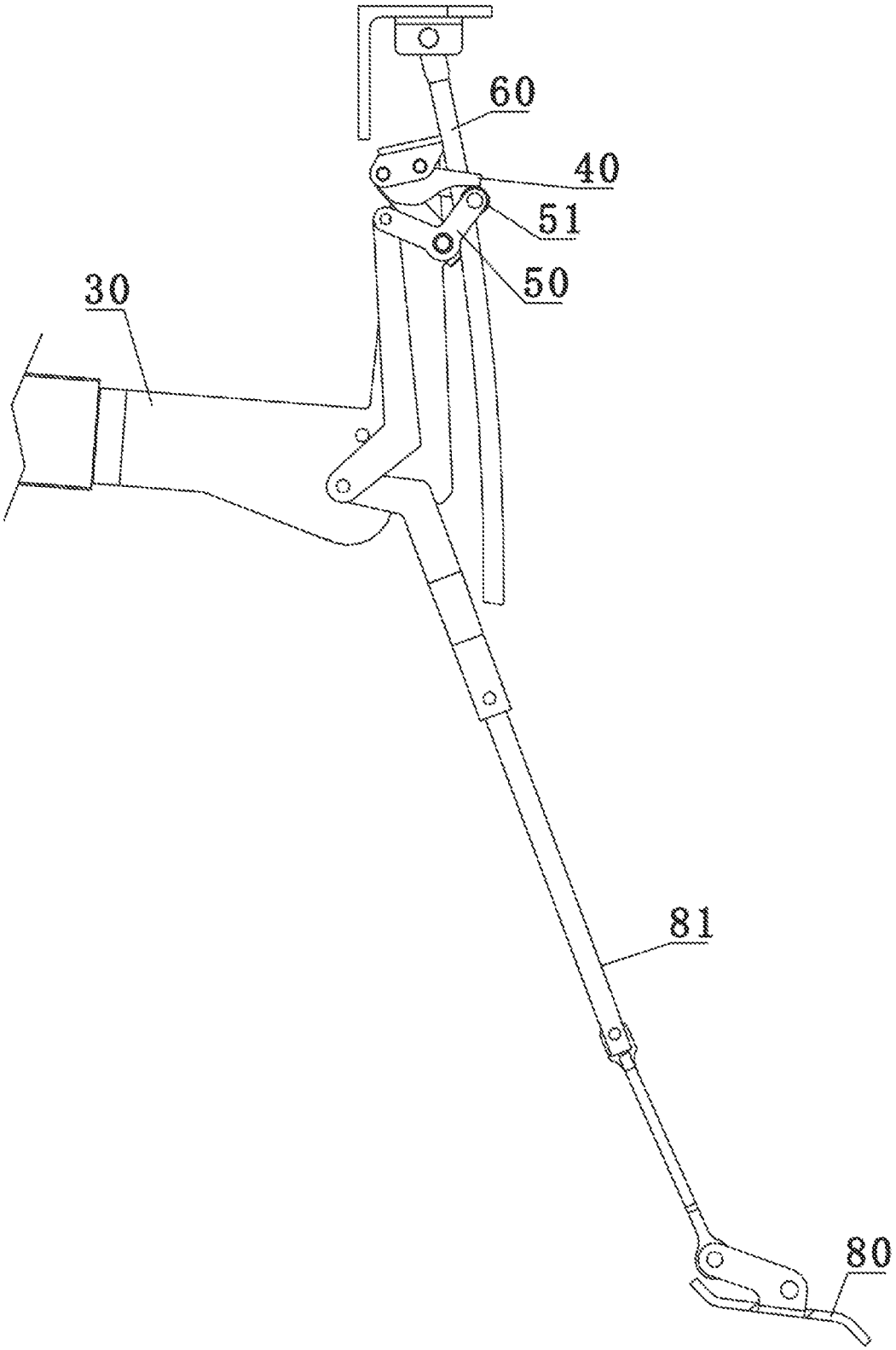
FIG. 6 is a connection view of parts of components of the woodworking vice according to the embodiment of this invention.
Figure 7:
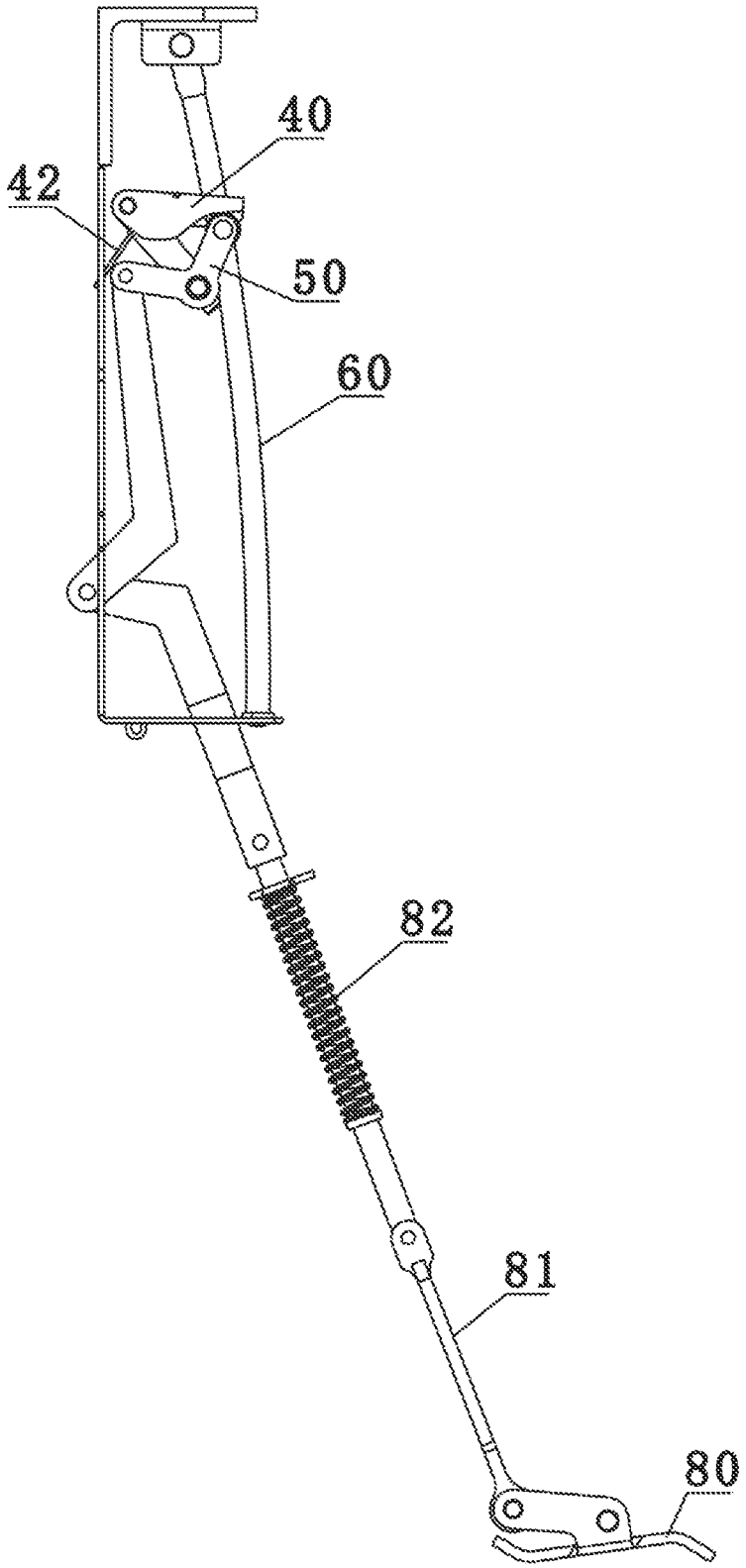
FIG. 7 is a connection view of parts of components of the woodworking vice including a compression spring according to the embodiment of this invention.
Figure 8:
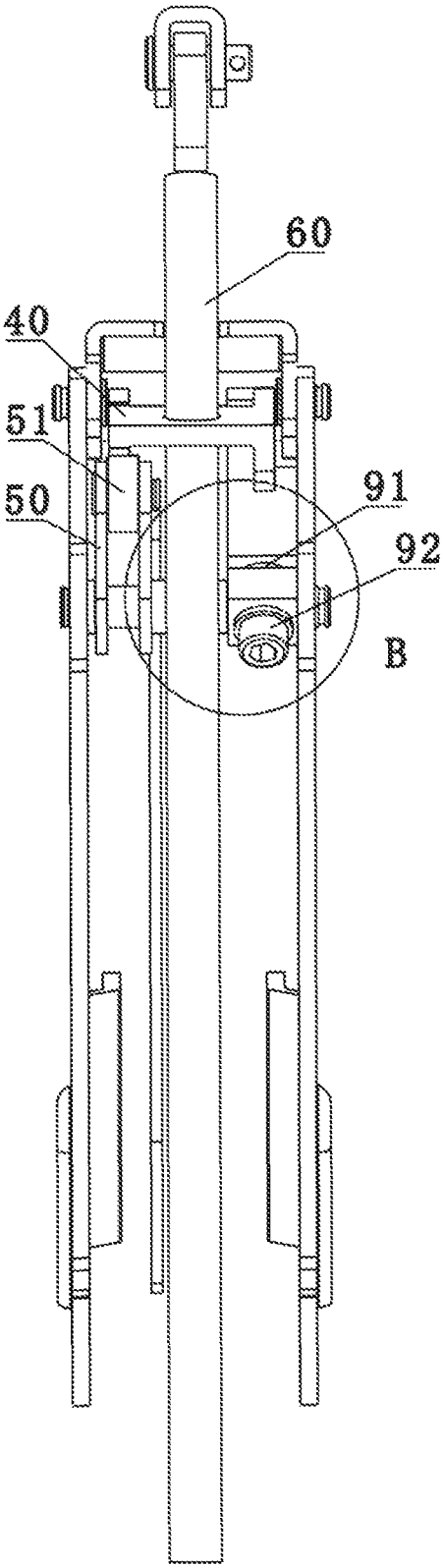
FIG. 8 is a right view of parts of components of the woodworking vice according to the embodiment of this invention.
Figure 9:
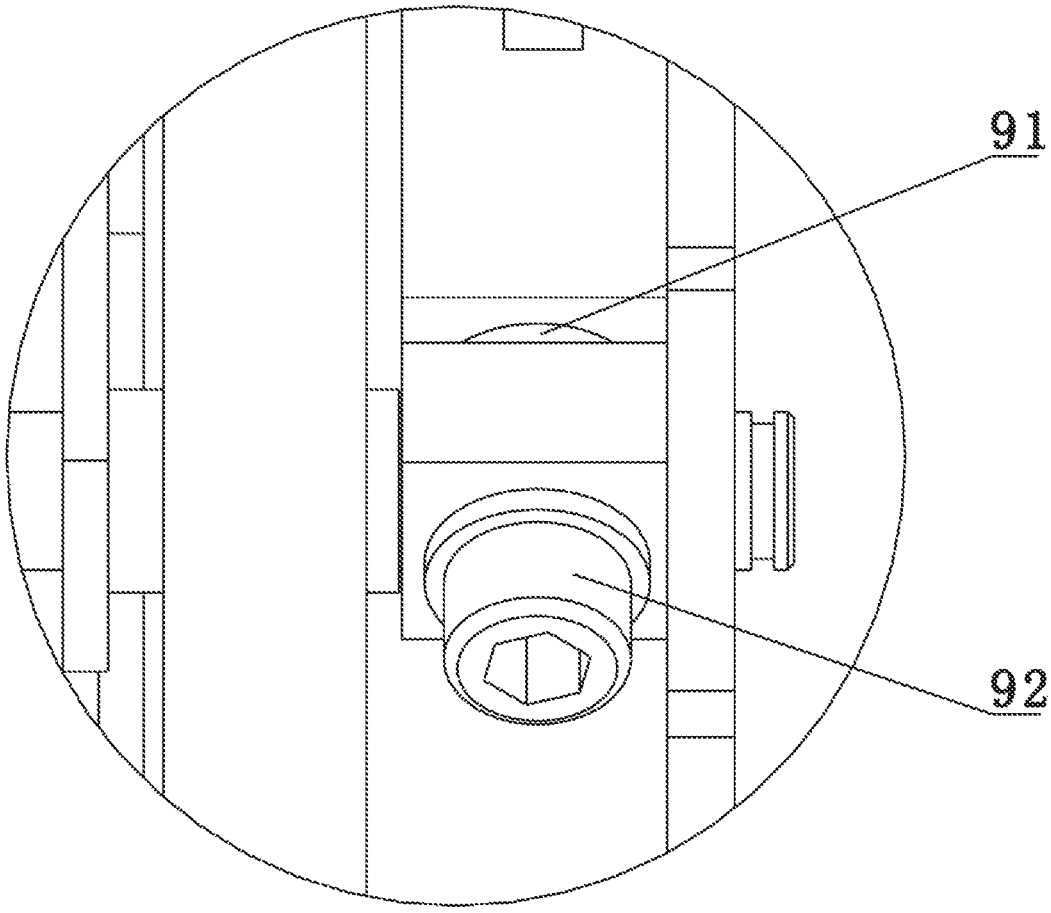
FIG. 9 is an enlarged view of a portion B of FIG. 8.

Embodiments are shown in FIG. 1 to FIG. 9. A woodworking vice includes a frame 10. The frame 10 is provided with a clamp assembly 20 and a connection rod 30 matching with the clamp assembly 20, and the front end of the connection rod 30 is hinged to the frame 10. That is, after the connection rod 30 is rotated clockwise, the clamp assembly 20 is locked; otherwise, after the connection rod 30 is rotated counterclockwise, the clamp assembly 20 is unlocked. Certainly, the connection rod 30 is preferably equipped with a resetting spring (not shown in the figures) which makes the connection rod 30 rotated counterclockwise.

Further:

The rear end of the connection rod 30 is provided with an extending frame 31 extending upwardly. That is, when viewed from the side, the connection rod 30 and the extending frame 31 may be "L" shaped, and the extending frame 31 may be cylindrical in shape. The front end of a locking member 40 is hinged to the upper end of the extending frame 31, and the middle portion of a rocker 50 is hinged to the upper end of the extending frame 31 and is located below the locking member 40. Further, the locking member 40 is provided with a cooperation hole 41, and the locking member 40 is provided with a torsion spring 42 which has a tendency of rotating clockwise. The rear portion of the frame 10 is provided with a locking rod 60 extending downwardly, and the locking rod 60 passes through and is disposed in the cooperation hole 41. The rear end of the rocker 50 is matched with the locking member 40. That is, the rear end of the rocker 50 is against below the locking member 40. In general, the torsion spring 42 makes the locking member 40 be in a non-horizontal state, such that the cooperation hole 41 locks the locking rod 60 so that the locking member 40 cannot move up and down, and the connection rod 30 cannot be rotated, thereby achieving locking; on the contrary, once the locking member 40 is leveled under the action of an external force, the cooperation hole 41 no longer locks the locking rod 60, the locking member 40 can move up and down freely, and the connection rod 30 can be freely rotated so as to achieve unlocking.

The rear end of the connection rod 30 is connected with a bracket 70 extending downwardly, and the bracket 70 cannot rotate clockwise relative to the connection rod 30. For example, the connection rod 30 is fixed with a limiting rod extending to the right, and the bracket 70 is provided with a strip-shaped limiting hole extending in the up-and-down direction, the limiting rod is inserted in the limiting hole, and the limiting rod has a certain movement amount in the up-and-down direction. The middle portion of a pedal 80 is hinged to the lower end of the bracket 70, the front end of the pedal 80 is connected with a transmission rod 81, and the upper end of the transmission rod 81 is connected with the front end of the rocker 50.

In this way, since the locking rod 60 locks the locking member 40 under normal circumstances, the heel of a foot only needs to step down on the rear portion of the pedal 80, the connection rod 30 can be rotated clockwise and cannot be reset by itself, and therefore the clamp assembly 20 is locked; and when the clamp assembly 20 needs to be released, the sole of the foot only needs to step down on the front portion of the pedal 80, the transmission rod 81 can drive the front end of the rocker 50 to move downwardly, the rear end of the rocker 50 moves upwardly to hold against the locking member 40 to be horizontal, the cooperation hole 41 and the locking rod 60 can no longer lock, and the connection rod 30 will be immediately rotated clockwise to unlock the clamp assembly 20.

Optimally:

The transmission rod 81 is provided with a compression spring 82 which has a tendency of moving upwardly. That is, the compression spring 82 can reset the pedal 80 in time, and the rear end of the rocker 50 always tends to go downwardly, ensuring that the locking rod 60 locks the locking member 40.

The rear end of the rocker 50 is provided with a supporting wheel 51, and the supporting wheel 51 is below and supports the locking member 40 which ensures smooth operation.

Continue to Optimize:

The extending frame 31 is fixed with a retractable member 90 extending upwardly, the upper end of the retractable member 90 is hinged to a swing arm 93, and the locking member 40 is hinged to the swing arm 93. In this embodiment, the retractable member 90 may include a thread insert 91 and a screw 92 screwed into the thread insert 91. At this time, the upper end of the thread insert 91 can be hinged to the swing arm 93, and the middle portion of the rocker 50 can be hinged to the extending frame 31. Thus, when the aperture of the cooperation hole 41 becomes larger due to wear, the length of the retractable member 90 can be adjusted so that the angle between the locking member 40 and the horizontal plane can be larger, ensuring that the locking rod 60 can always well lock the cooperation hole 41.

The above-mentioned description is only a preferred embodiment of this invention and is not intended to limit the scope of this invention. The equivalent structures or equivalent process transformations made by using the description and the drawings of this invention, or directly or indirectly applied to other related technical fields, are all included in the scope of patent protection of this invention in like manner.

What is claimed is:

1. A woodworking vice, comprising a frame, wherein the frame is provided with a clamp assembly and a connection rod matching with the clamp assembly, and a front end of the connection rod is hinged to the frame;

wherein a rear end of the connection rod is provided with an extending frame extending upwardly, a front end of a locking member is hinged to an upper end of the extending frame, a middle portion of a rocker is hinged to the upper end of the extending frame and is located below the locking member, a rear portion of the frame is provided with a locking rod extending downwardly, the locking member is provided with a cooperation hole, the locking member is equipped with a torsion spring making the locking member have a tendency of rotating clockwise, the locking rod passes through the cooperation hole, and a rear end of the rocker is matched with the locking member; and wherein the rear end of the connection rod is connected with a bracket extending downwardly, the bracket is unable to rotate clockwise relative to the connection rod, a middle portion of a pedal is hinged to a lower end of the bracket, a front end of the pedal is connected with a transmission rod, and an upper end of the transmission rod is connected with a front end of the rocker.

2. The woodworking vice according to claim 1, wherein the transmission rod is equipped with a compression spring making the transmission rod have a tendency of moving upwardly.

3. The woodworking vice according to claim 1, wherein the rear end of the rocker is provided with a supporting wheel, and the supporting wheel is below and supports the locking member.

4. The woodworking vice according to claim 1, wherein the extending frame is fixed with a retractable member extending upwardly, an upper end of the retractable member is hinged to a swing arm, and the locking member is hinged to the swing arm.

5. The woodworking vice according to claim 4, wherein the retractable member comprises a thread insert and a screw screwed into the thread insert.

* * * * *